US009433047B2

(12) United States Patent
Huynh et al.

(10) Patent No.: US 9,433,047 B2
(45) Date of Patent: Aug. 30, 2016

(54) SINGLE INDUCTOR MULTIPLE LED STRING DRIVER

(75) Inventors: Steven Huynh, Fremont, CA (US); Cuong Van Pham, Hanoi (VN)

(73) Assignee: Active-Semi, Inc. (VG)

( * ) Notice: Subject to any disclaimer, the term of this patent is extended or adjusted under 35 U.S.C. 154(b) by 1456 days.

(21) Appl. No.: 12/925,059

(22) Filed: Oct. 12, 2010

(65) Prior Publication Data

US 2012/0043912 A1 Feb. 23, 2012

Related U.S. Application Data

(60) Provisional application No. 61/402,106, filed on Aug. 23, 2010.

(51) Int. Cl.
*H05B 33/08* (2006.01)

(52) U.S. Cl.
CPC ..... *H05B 33/0827* (2013.01)

(58) Field of Classification Search
CPC ..... H05B 33/0827; H05B 33/0806; H05B 33/083; H05B 33/0866; H05B 41/36; H05B 41/3927; H05B 37/02
USPC ..... 315/185 S, 185 R, 209 R, 224, 291, 294, 315/297, 299, 307
See application file for complete search history.

(56) References Cited

U.S. PATENT DOCUMENTS

| | | | | |
|---|---|---|---|---|
| 5,661,645 | A * | 8/1997 | Hochstein | 363/89 |
| 7,498,793 | B2 | 3/2009 | Xu | 323/288 |
| 2004/0036418 | A1 * | 2/2004 | Rooke | H05B 33/0815 315/77 |
| 2008/0012502 | A1 | 1/2008 | Lys | 315/247 |

(Continued)

FOREIGN PATENT DOCUMENTS

| | | | |
|---|---|---|---|
| CN | 1675605 | A | 8/2002 |
| CN | 101646283 | A | 8/2008 |
| CN | 202183892 | U | 10/2010 |

OTHER PUBLICATIONS

Hanh-Phuc Le et al., A Single-Inductor Switching DC-DC Converter With Five Outputs and Ordered Power-Distributive Control, IEEE Journal of Solid-State Circuits, vol. 42, No. 12 dated Dec. 2007 (9 pages).

(Continued)

*Primary Examiner* — Jimmy Vu
*Assistant Examiner* — Henry Luong
(74) *Attorney, Agent, or Firm* — Imperium Patent Works; Zheng Jin; Amir Adibi

(57) ABSTRACT

A single inductor multiple LED string driver comprises a switch control circuit and a current-sensing control circuit. The switch control circuit generates a plurality of digital control signals that are used to control a plurality of switches coupled to a plurality of strings of LEDs. Each switch is selectively turned on and off by each corresponding digital control signal. The current-sensing control circuit determines an integrated charge amount provided by each current that flows from an input voltage through each LED string, through each switch, through a common inductor, and through a main switch to ground. In response to the determined integrated charge amount, the current-sensing control circuit generates an on-time control signal that controls the on-time of each switch such that the average current flowing across each LED string is equal to each other. Furthermore, the total current flowing across each LED string is regulated to a predefined value.

27 Claims, 9 Drawing Sheets

FUNCTIONAL BLOCK DIAGRAM

(56) References Cited

U.S. PATENT DOCUMENTS

| | | | | |
|---|---|---|---|---|
| 2008/0054815 | A1 | 3/2008 | Kotikalapoodi et al. | 315/192 |
| 2010/0033109 | A1 | 2/2010 | Liu et al. | 315/294 |
| 2010/0283322 | A1* | 11/2010 | Wibben | 307/31 |
| 2010/0295472 | A1* | 11/2010 | Wibben et al. | 315/294 |

OTHER PUBLICATIONS

SIPO, Office Action for CN patent application 201110077417.4 dated May 29, 2014 (3 pages).

* cited by examiner

FIRST EMBODIMENT

FUNCTIONAL BLOCK DIAGRAM

STATE MACHINE

TYPICAL WAVEFORMS

FLOWCHART

SECOND EMBODIMENT

THIRD EMBODIMENT

SINGLE INDUCTOR MULTIPLE LED STRING DRIVER

CROSS REFERENCE TO RELATED APPLICATIONS

This application claims priority under 35 U.S.C. §119 from U.S. Provisional Application No. 61/402,106, entitled "Single Inductor Multiple LED String Driver," filed on Aug. 23, 2010, the subject matter of which is incorporated herein by reference.

TECHNICAL FIELD

The present disclosure relates generally to Light-Emitting Diode ("LED") supply, control, and protection circuits; and more specifically to controllers that drive multiple LED strings using a single inductor.

BACKGROUND INFORMATION

Light-Emitting Diodes or "LEDs" are increasingly being used for general lighting purposes. For example, LEDs are suitable for backlighting for LCD televisions, lightweight laptop displays, and light source for DLP projectors. Screens for televisions and computer displays can be made increasingly thin using LEDs for backlighting. In LED backlights, multiple strings of LEDs are arranged in parallel, and each string of LEDs has series-connected LEDs. To achieve good quality backlighting, various controllers are used to regulate the currents flowing across the multiple strings of LEDs.

FIG. 1 (Prior Art) is a diagram of a multiple LED string driver 10 comprising a boost converter 11 that drives multiple strings of LEDs via resistor ballasting. Boost converter 11 is driven by a feedback signal 14 across a resistor 16 that senses the current through one of the LED string 15. The output voltage VOUT of boost converter 11 is regulated to provide the necessary current. For the other LED strings, each has an identical resistor so that the current flowing through all LED strings are approximately the same. The variation of the LED string current, however, depends on how the LED forward voltages and the feedback voltage are matched. For example, if the total forward voltages of two LED strings are different by 1V, and the feedback voltage is 2V, then the mismatch in LED string current is 1V/2V=50%.

FIG. 2 (Prior Art) is a diagram of a multiple LED string driver 20 comprising an LED bias controller 21 that drives multiple strings of LEDs, each biased separately by a current sync. The current syncs are inside controller 21 and coupled to terminals CTRL1-CTRL6 (22-27) of controller 21. A power converter provides a regulated output voltage VOUT to the top of the LED strings, and the LED string current is each regulated by the current syncs. For best efficiency, the power converter output voltage VOUT is adaptively regulated so that only a necessary working voltage is dropped across the current syncs. The advantage of this approach is the LED string currents have high matching to each other. The disadvantage is that the total forward voltage variation from string to string is significant. As a result, the voltages across the current syncs vary, resulting in significant power loss and heat generation. For example, if the total forward voltages for two long LED strings are 200V and 180V respectively, then there is an additional 20V voltage drop across the current sync for the 180V forward voltage LED string. At 120 mA bias current, such a voltage drop results in an additional 2.4 W higher dissipation on the second LED string than the first LED string.

FIG. 3 (Prior Art) is a diagram of a multiple LED string driver 30 comprising a DC-to-DC controller 31 that drives multiple strings of LEDs. A boost converter 32 converts a 24V input DC voltage to a regulated output DC voltage VOUT (e.g., ~100-200V) to the top of the LED strings. Each LED string bottom is separately driven by an LED string switching converter. Each LED string switching converter (e.g., switching converter 35), comprises a MOSFFET 36, an inductor 37, a diode rectifier 38, and a current sense resistor 39. Each LED switching converter individually operates like a buck converter, reducing the main output voltage to match the LED string total forward voltage so that each LED string current is regulated to a target value. As a result, there is no power loss caused by the voltage difference between the main output voltage and the LED string total forward voltage. However, because each LED string needs a separate switching converter having a separate inductor, the overall cost is high.

SUMMARY

A single inductor multiple LED string driver comprises a switch control circuit and a current-sensing control circuit. The switch control circuit generates a plurality of digital control signals that are used to control a plurality of LED switches coupled to a plurality of strings of LEDs. Each switch is selectively turned on and off by each corresponding digital control signal. The current-sensing control circuit determines an integrated charge amount provided by each current that flows from an input voltage through each LED string, through each LED switch, through a common inductor, and through a main switch to ground. In response to the determined integrated charge amount, the current-sensing control circuit generates an on-time control signal that controls the on-time of each LED switch such that the average current flowing across each LED string is equal to each other. Furthermore, the total current flowing across each LED string is regulated to a predefined value.

In one novel aspect, the single inductor multiple LED string driver has a time-shared Single-Inductor-Multiple-Output (SIMO) architecture. This architecture uses the common inductor to alternatively pump current into a holding capacitor of each LED string to generate equal average current for each LED string. The multiplexing of the common inductor allows current across each LED string to be individually regulated. Each multiplexing phase of the common inductor is essentially a buck conversion phase with individually adjustable on-time to drive each LED string separately. In one advantageous aspect, each LED string is biased without power loss due to the voltage difference between the main output voltage and the LED string total forward voltage. In addition, only a single inductor is used.

In one embodiment, the single inductor multiple LED string driver is part of an integrated circuit. The switch control circuit is a Pulse-Width Modulation (PWM) controller. The plurality of LED switches and the main switch are located inside or outside the integrated circuit. In one advantageous aspect, an AC-to-DC converter is used to output an unregulated DC voltage VHIGH. The unregulated DC voltage VHIGH is then directly used to drive the plurality of LED strings without using any DC-to-DC boost converter such that additional efficiency loss is eliminated.

Other structures and methods are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Figure 4:
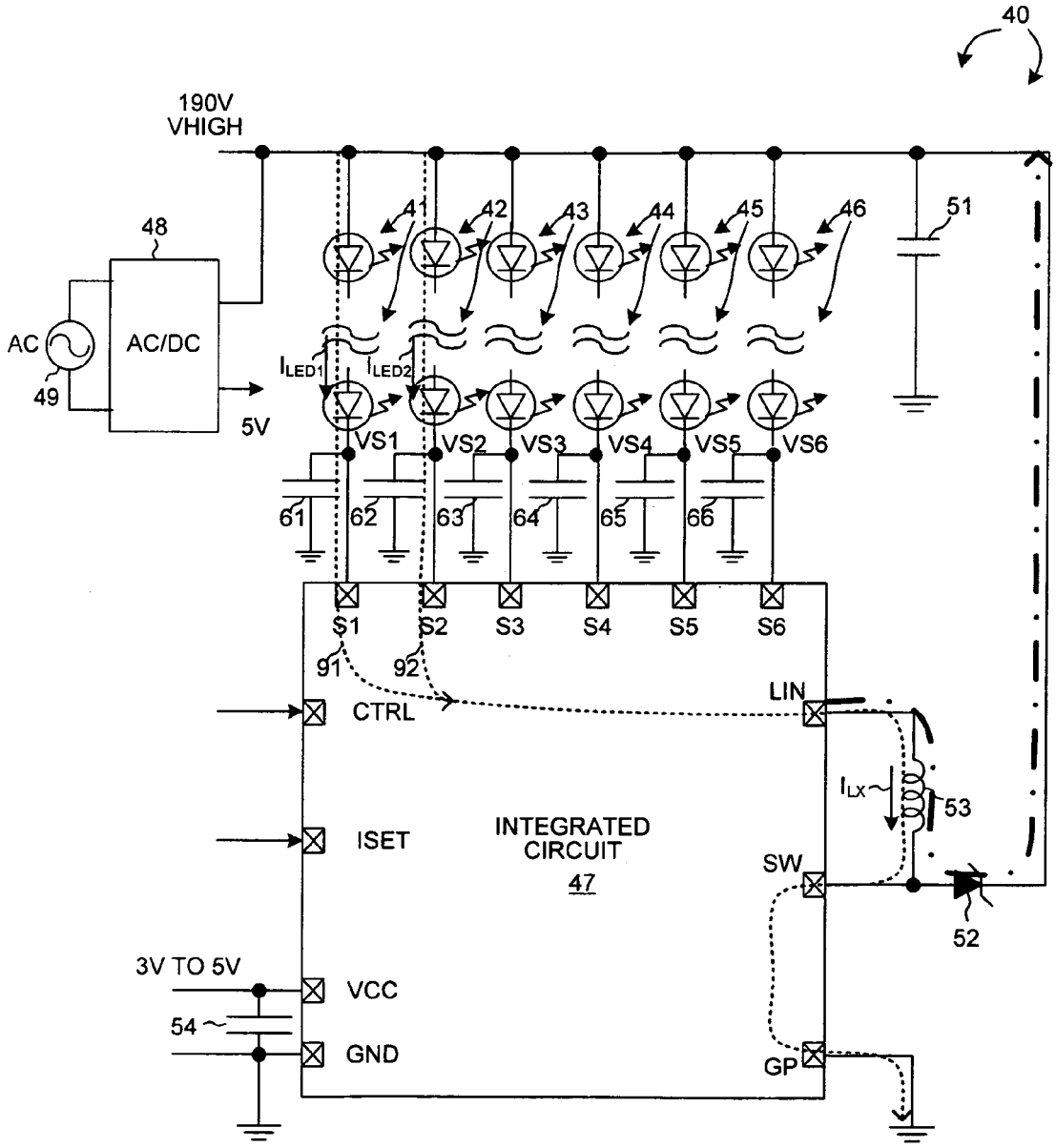
FIG. 4 is a diagram of a first embodiment of a single inductor multiple LED string driver in accordance with one novel aspect.

FIG. 4 is a diagram of a first embodiment of a single inductor multiple LED string driver 40 in accordance with one novel aspect. Single inductor multiple LED string driver 40 comprises a plurality of strings of LEDs 41-46, an integrated circuit 47, an AC-to-DC converter 48, an output capacitor 51, a diode rectifier 52, and a common inductor 53. Each LED string comprises a number of series-connected LEDs. The top of each LED string is connected to a DC voltage VHIGH as illustrated, while the bottom of each LED string is connected to an LED switch terminal S1-S6 of integrated circuit 47 respectively. The bottom of each LED string is also connected to a holding capacitor 61-66 respectively. In addition to the six LED switch terminals S1-S6, integrated circuit 47 also comprises a CTRL terminal for control interface, a ISET terminal for reference current, a main switch terminal SW, an input terminal LIN, a supply voltage terminal VCC, as well as two ground terminals GND and GP.

Figure 1:
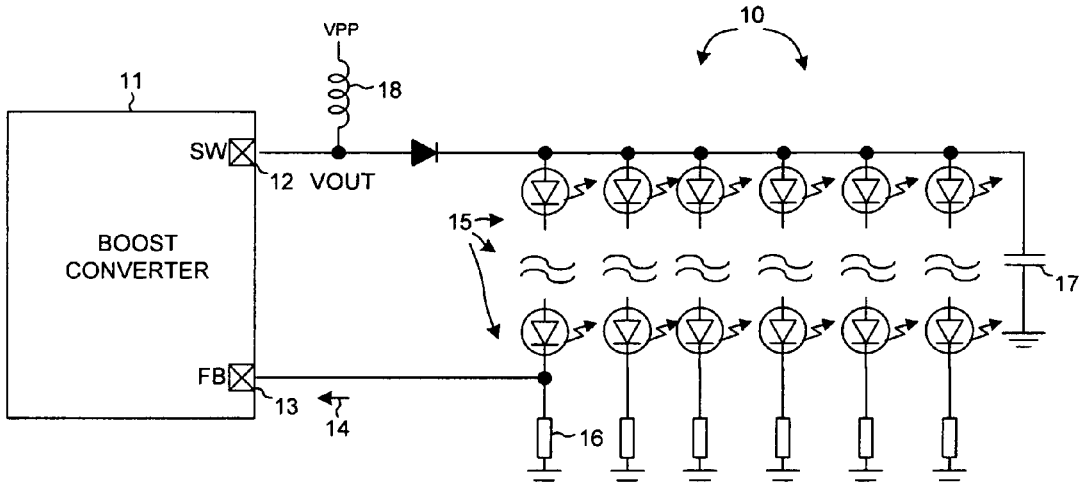
(PRIOR ART) FIG. 1
FIG. 1 (Prior Art) is a diagram of a multiple LED string driver comprising a boost converter that drives multiple strings of LEDs via resistor ballasting.
Figure 2:
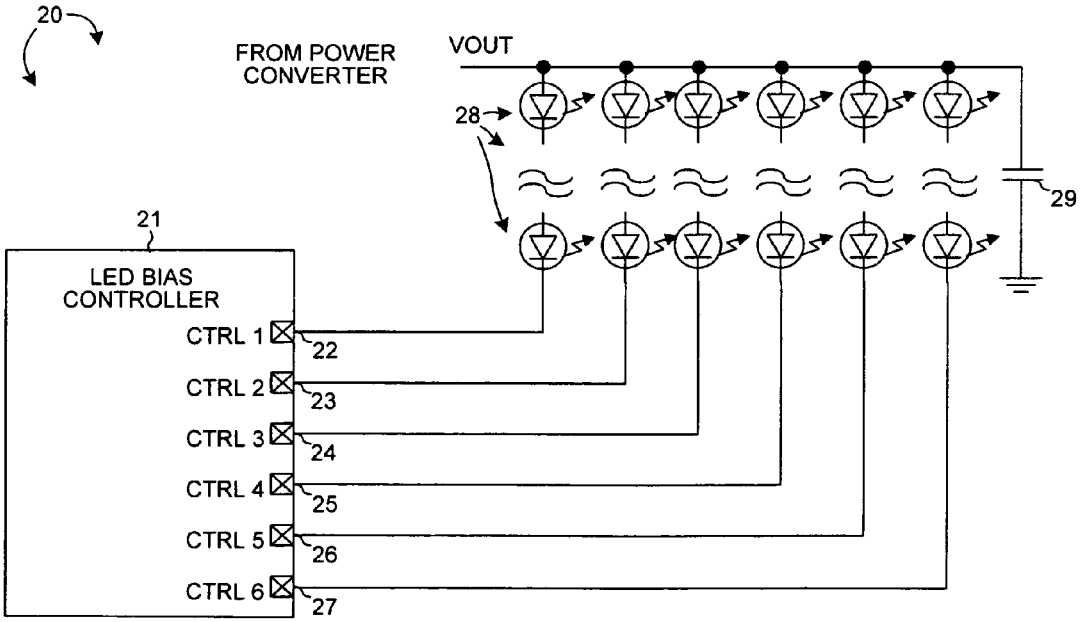
(PRIOR ART) FIG. 2
FIG. 2 (Prior Art) is a diagram of a multiple LED string driver comprising an LED bias controller that drives multiple strings of LEDs via separate current syncs.
Figure 3:
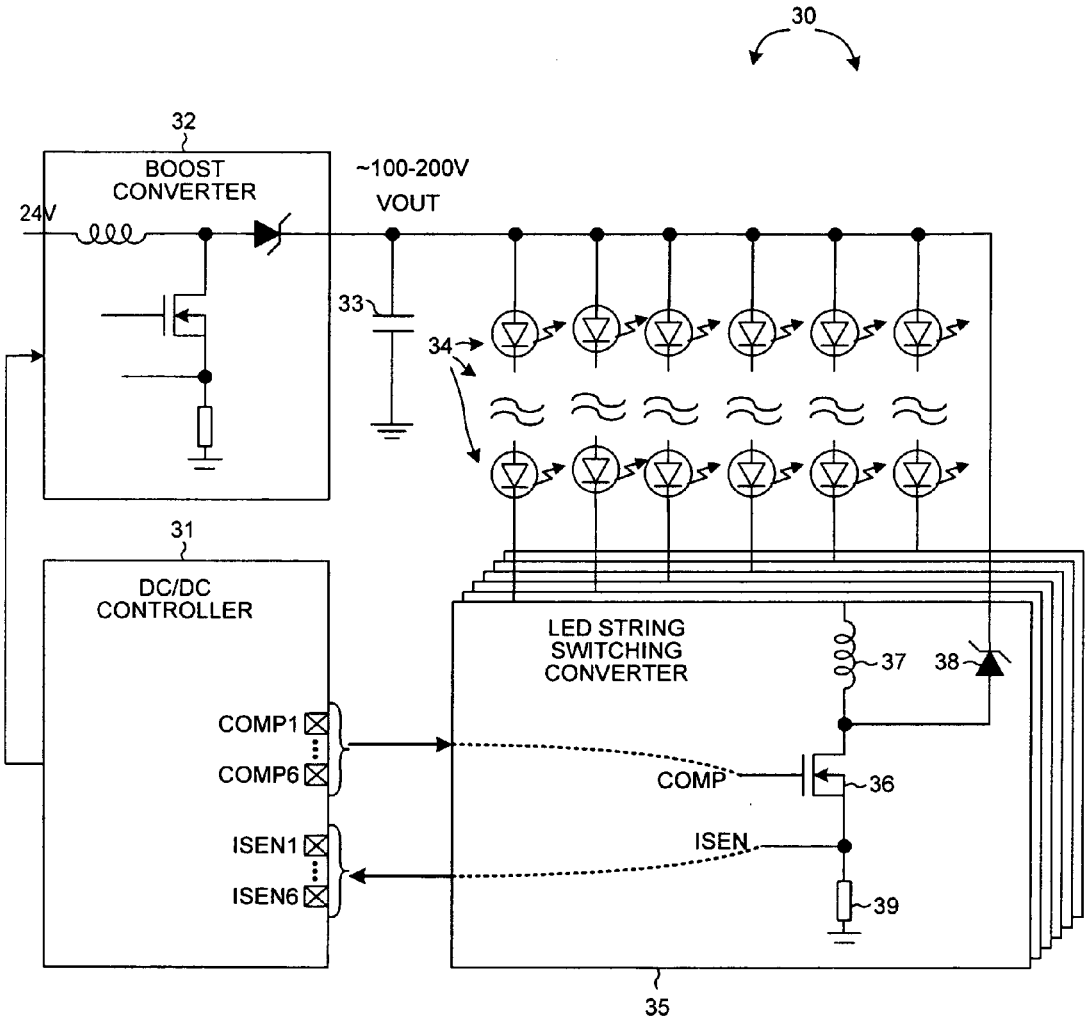
(PRIOR ART) FIG. 3
FIG. 3 (Prior Art) is a diagram of a multiple LED string driver comprising a DC-to-DC controller that drives multiple strings of LEDs via separate LED string switching converter.

In the example of FIG. 4, AC-to-DC converter 48 receives voltage from an AC voltage source 49 (e.g., 110V AC) and outputs a regulated 5V DC voltage. The 5V DC voltage is commonly used in many electronic devices. AC-to-DC converter 48 also outputs an unregulated secondary DC voltage VHIGH. The value of VHIGH is determined approximately based on the winding ratio of the AC-to-DC converter. In one advantageous aspect, the unregulated DC voltage VHIGH is then directly used to drive the plurality of LED strings, without using any additional DC-to-DC boost converter. For example, if each LED string has 45 series-connected LEDs, then the total forward voltage of the LED string is about 45×3.3=150V. The supply voltage VHIGH is about 190V, leaving ~40V for normal operation. By directly using the unregulated voltage from AC-to-DC converter 48, ~20% of efficiency loss can be eliminated as compared to LED string driver 30 in FIG. 3.

Single inductor multiple LED string driver 40 is commonly used in applications such as backlighting for LCD televisions, LCD monitors, lightweight laptop displays, and light source for DLP projectors. In order to efficiently regulate the currents that flow across each of the six LED strings, each LED string is individually biased through the use of six LED switch terminals S1-S6, common inductor 53, and main switch terminal SW. First, each LED switch terminal is connected to an LED switch (not shown) that provides an active current sync for each LED string. In addition, the main switch terminal SW is connected to a main switch (not shown) that drives common inductor 53. As a result, when both the main switch and one of the LED switches are turned on, an LED string current ($I_{LED1}$ to $I_{LED6}$) flows from VHIGH, through an LED string, through a corresponding LED switch, through common inductor 53, and then through the main switch to ground. The main switch operates cooperatively with the six LED switches such that, together with a single inductor, they provide independently controllable current syncs for the six LED strings.

In one novel aspect, single inductor multiple LED string driver 40 has a time-shared Single-Inductor-Multiple-Output (SIMO) architecture. This architecture uses common inductor 53 to alternatively pump current into the holding capacitors (61-66) of each LED strings (41-46) to generate equal average current for each LED string. The multiplexing of common inductor 53 allows current across each LED string ($I_{LED1}$-$I_{LED6}$) to be individually regulated. For example, during a first on-time, the first LED switch is turned on. The first LED string current $I_{LED1}$ flows from VHIGH, through the first LED string 41, through terminal S1, through common inductor 53, and through terminal SW to ground (denoted by a thick dotted line 91). When the integrated charge from $I_{LED1}$ reaches a target value, the first LED switch is then turned off. Next, the second LED switch is turned on during the second on-time so that the second LED string current $I_{LED2}$ flows from VHIGH, through the second LED string 42, through terminal S2, through common inductor 53, and through terminal SW to ground (denoted by a thick dotted line 92). Similar to the first on-time, the second LED switch is turned off when the integrated charge from $I_{LED2}$ reaches the same target value. The same process is repeated for each LED string. While each LED string current varies when the corresponding LED switch is turned on and off, each holding capacitor (61-66) averages the LED string current over time. Because the amount of charge pumped into each holding capacitor is equal to the same target value, the average current of each LED string is the same. Thus, each multiplexing phase of common inductor 53 is essentially a buck conversion phase with individually adjustable on-time to drive each LED string separately. In one advantageous aspect, each LED string is biased without power loss due to the voltage difference between the main output voltage and the LED string total forward voltage. In addition, only a single inductor 53 is used as compared to multiple inductors in FIG. 3.

Figure 5:
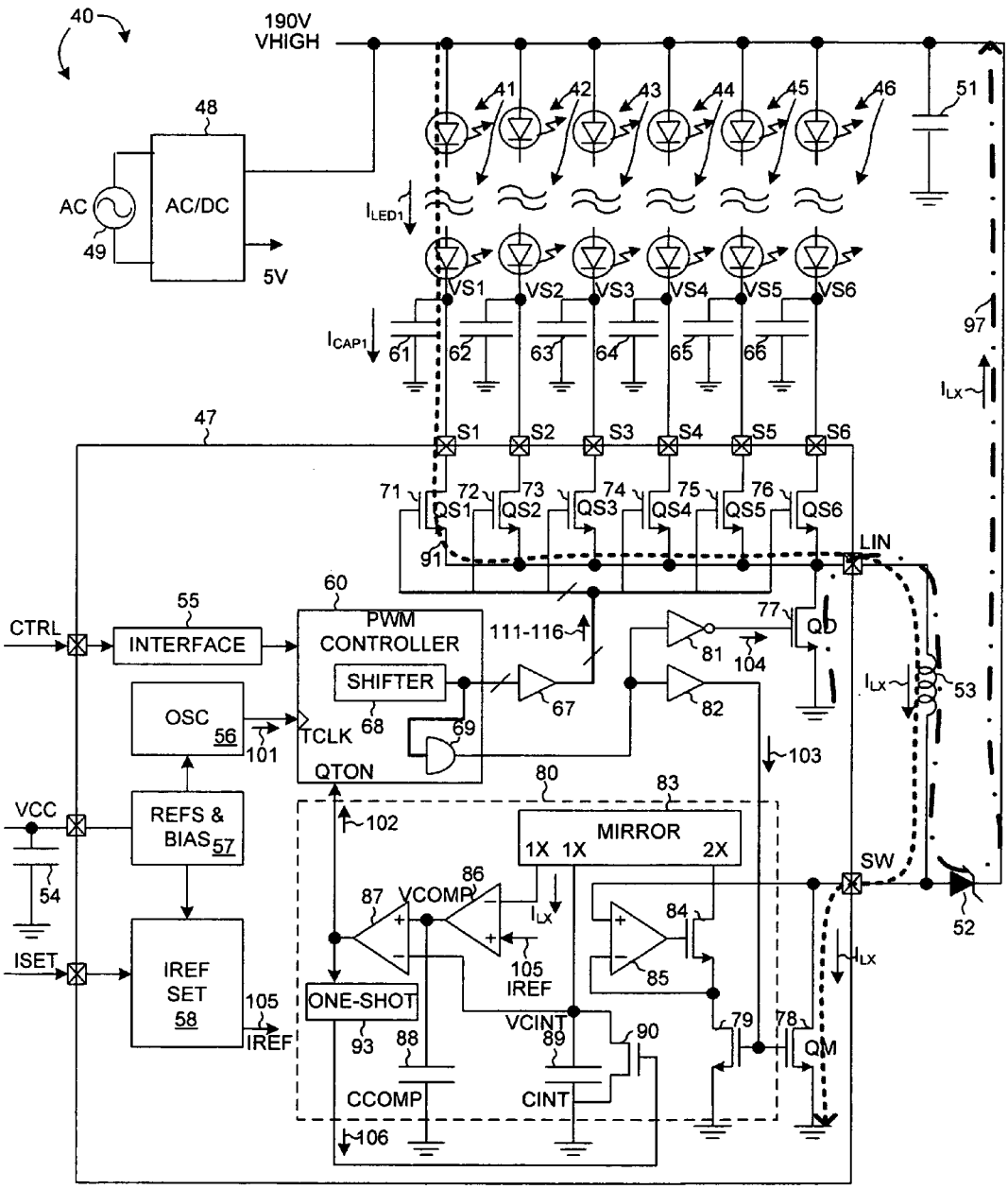
FIG. 5 is a more detailed circuit diagram of the single inductor multiple LED string driver of FIG. 4.

FIG. 5 is a more detailed circuit diagram of the single inductor multiple LED string driver 40 of FIG. 4. In the example of FIG. 5, integrated circuit 47 comprises an interface module 55, an oscillator 56, a reference and bias module 57, an current reference IREF module 58, a switch control circuit 60, a plurality of switches QS1-QS6 (71-76), a discharge switch QD 77, a main switch QM 78, and a current-sensing control circuit 80. The plurality of switches QS1-QS6 are the six LED switches described above (but not shown) with respect to FIG. 4, and the main switch QM 78 is the main switch described above (but not shown) with respect to FIG. 4. Although the LED switches QSn, the main switch QM, and the discharge switch QD are all located inside integrated circuit 47 in the example of FIG. 5, any of the LED switches QSn, QM, and QD may be located outside integrated circuit 47 in other circuitry implementations.

Switch control circuit 60 in FIG. 5 is a Pulse-Width Modulation (PWM) controller, comprising a shifter 68 and an AND gate 69. PWM controller 60 receives a clock signal TCLK 101 from oscillator 56 that controls the period of a PWM switching cycle. PWM controller 60 also receives an on-time control signal QTON 102 from current-sensing control circuit 80, and in response generates a plurality of switch control signals 111-116 to control the plurality of LED switches QS1-QS6 respectively. Switch control signals 111-116 are supplied into AND gate 69 and buffer 82 to generate a first main switch control signal 103 that controls main switch QM 78. Switch control signals 111-116 are also supplied into AND gate 69 and inverter 81 to generate a second main switch control signal 104 that controls discharge switch QD 77.

A PWM switching cycle comprises a main on-time and a main off-time. The main on-time is multiplexed among the six QSn switches, while the main switch QM is also on. During the main off-time, main switch QM and all the six QSn switches are off, while the discharge switch QD is on. In other words, during a PWM main on-time, shifter 68 selectively turns on one of the LED switches QS1-QS6, while the main switch QM is also turned on and the discharging switch QD is turned off. On the other hand, during a PWM main off-time, only the discharge switch QD is turned on. The main on-time and off-time of the PWM switching cycle is either controlled by the PWM clock or by a minimum off-time mechanism. The on-time and off-time of each of the QSn switches, on the other hand, are controlled by on-time control signal QTON 102 such that the average current flowing across each QSn is equal to each other. On-time switch control signal QTON 102 is in turn controlled by current-sensing control circuit 80 by sensing the LED string current ($I_{LED1}$-$I_{LED6}$) that flows through main switch QM during the main on-time.

Current-sensing control circuit 80 comprises a current mirror 83, an error amplifier 86, a comparator 87, a compensation capacitor CCOMP 88, an integrating capacitor CINT 89, and a one-shot circuitry 93. During a PWM main on-time, when shifter 68 selectively turns on one of the LED switches QSn (i.e., QS1) via switch control signals 111-116 (i.e., control signal 111), current flows from VHIGH through one of the selected LED strings (i.e., $I_{LED1}$ flows across LED string 41), through the selected QSn, through common inductor 53, and through switch QM to ground (denoted by thick dotted line 91). That is, if QS1 is on, then the average inductor current $I_{LX}$ is equivalent to $I_{LED1}$ that flows across LED string 41. Current mirror 83 detects the inductor current $I_{LX}$ through main switch QM and outputs two mirrored currents (denoted as 1X, also referred to as a current sense signal), one flows into integrating capacitor CINT 89, and the other flows into current error amplifier 86. The two mirrored currents are used for two different purposes.

First, when the current sense signal of inductor current $I_{LX}$ flows into integrating capacitor CINT 89, the voltage across CINT 89 VCINT increases from zero Volts. Voltage VCINT indicates the amount of charge accumulated through $I_{LX}$ over time (i.e., $I_{LED1}$ when QS1 is on). VCINT is then compared with a voltage VCOMP by comparator 87. When VCINT becomes higher than VCOMP, on-time switch control signal QTON 102 is generated to turn off one of the selected LED switches QSn (i.e., QS1). VCINT is then reset to zero Volts for the next QSn on-time. For example, VCINT may be reset by switch 90 by a one-shot reset signal 106 generated by the on-time switch control signal QTON 102. Because each LED string is current biased, the average LED string current can be regulated by regulating the amount of charge accumulated through the LED string current. Assume that VCOMP remains as a constant voltage value, by comparing VCINT to VCOMP to control the on-time of each LED switch, the amount of charge accumulated through each LED string during the on-time of each LED switch also remains the same. As a result, the average LED string current flowing across each LED string is regulated to be equal to each other.

Second, the current sense signal of inductor current $I_{LX}$ is compared with a reference current IREF 105 by error amplifier 86. An output voltage signal VCOMP is generated by error amplifier 86 for all LED strings. If the combined average inductor current $I_{LX}$ is less than IREF 105, then the voltage VCOMP outputted by error amplifier 86 increases. Otherwise, if the combined average inductor current $I_{LX}$ is more than IREF 105, then the voltage VCOMP outputted by error amplifier 86 decreases. Therefore, by regulating the combined current sense value to reference current $I_{REF}$ 105, VCOMP remains the same, and the total current flows across each LED string is regulated to a predefined value. The LED string current $I_{LEDn}$ is typically equal to IREF multiplied by a constant. Thus, by selecting an appropriate IREF value, the LED string current $I_{LEDn}$ can be regulated to a desired value.

Figure 6:
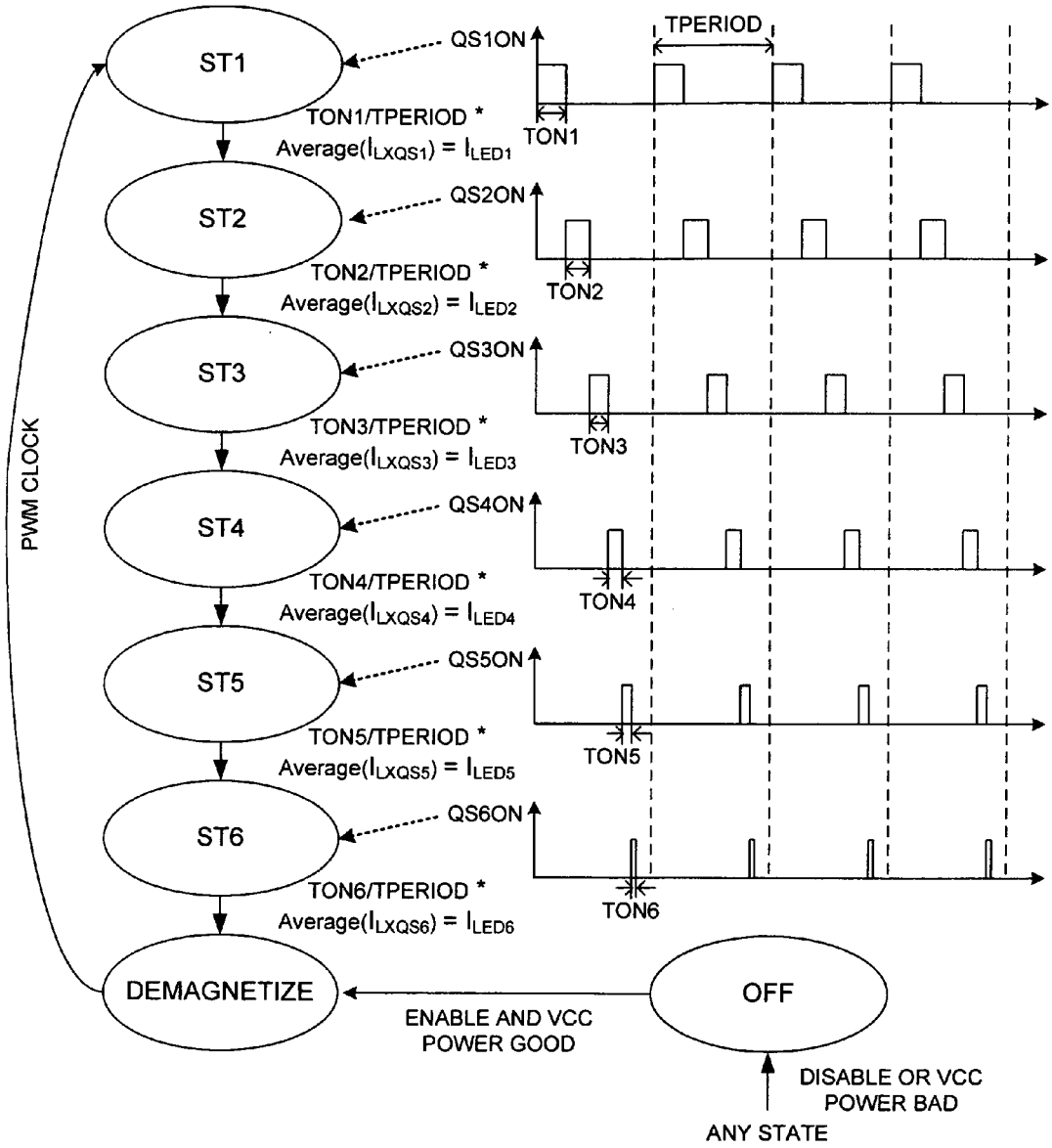
FIG. 6 illustrates different states during a PWM switching cycle of the single inductor multiple LED string driver of FIG. 5.

FIG. 6 illustrates different states during a PWM switching cycle of the single inductor multiple LED string driver 40 of FIG. 5. Single inductor multiple LED string driver 40 starts with an initial OFF state, during which it is disabled or does not have good supply voltage. Single inductor multiple LED string driver 40 enters demagnetize (or discharge) state after it is enabled and receives good supply voltage. During any PWM switching cycle, single inductor multiple LED string driver 40 goes through state ST1, ST2, ST3, ST4, ST5, ST6, and then goes back to demagnetize state before repeating a next PWM switching cycle. Four PWM switching cycles are illustrated in FIG. 6, and the main-on time in each PWM switching cycle is divided among the six QSn switches. State ST1 represents the state where the first switch QS1 is turned on during TON1, state ST2 represents the state where the second switch QS2 is turned on during TON2, and so on so forth. From any of the states, single inductor multiple LED string driver 40 goes back to the OFF state if it is disabled or does not have good supply voltage.

Because at any moment only one QSn switch is turned on by PWM controller 60 during the main on-time of a PWM switching cycle, the LED string current $I_{LEDn}$ across each LED string flows through the inductor only when its corresponding QSn switch is turned on. As a result, in any steady state of ST1-ST6, the average current flowing through each LED string is equal to the average current through the inductor during the on-time of the corresponding QSn switch:

$$\text{Average}(I_{LEDn}) = \frac{TONn}{TPERIOD} \cdot \text{Average}(I_{LXQSn}) \quad (1)$$

Where $I_{LEDn}$ is the average current of LED string n

TONn is the on-time of the QSn switch

TPERIOD is the main switching cycle period $I_{LXQSn}$ is the average inductor current during QSn switch on-time For all six LED strings, the total average current flowing through all six LED strings is thus equal to the total average current through the inductor during the main on-time. Therefore, if equation (1) is added up for all six LED strings, the result becomes:

$$\sum_{n=1}^{n=6} \text{Average}(I_{LEDn}) = \sum_{n=1}^{n=6} \frac{TONn}{TPERIOD} * \text{Average}(I_{LXQSn}) \quad (2)$$

Figure 7:
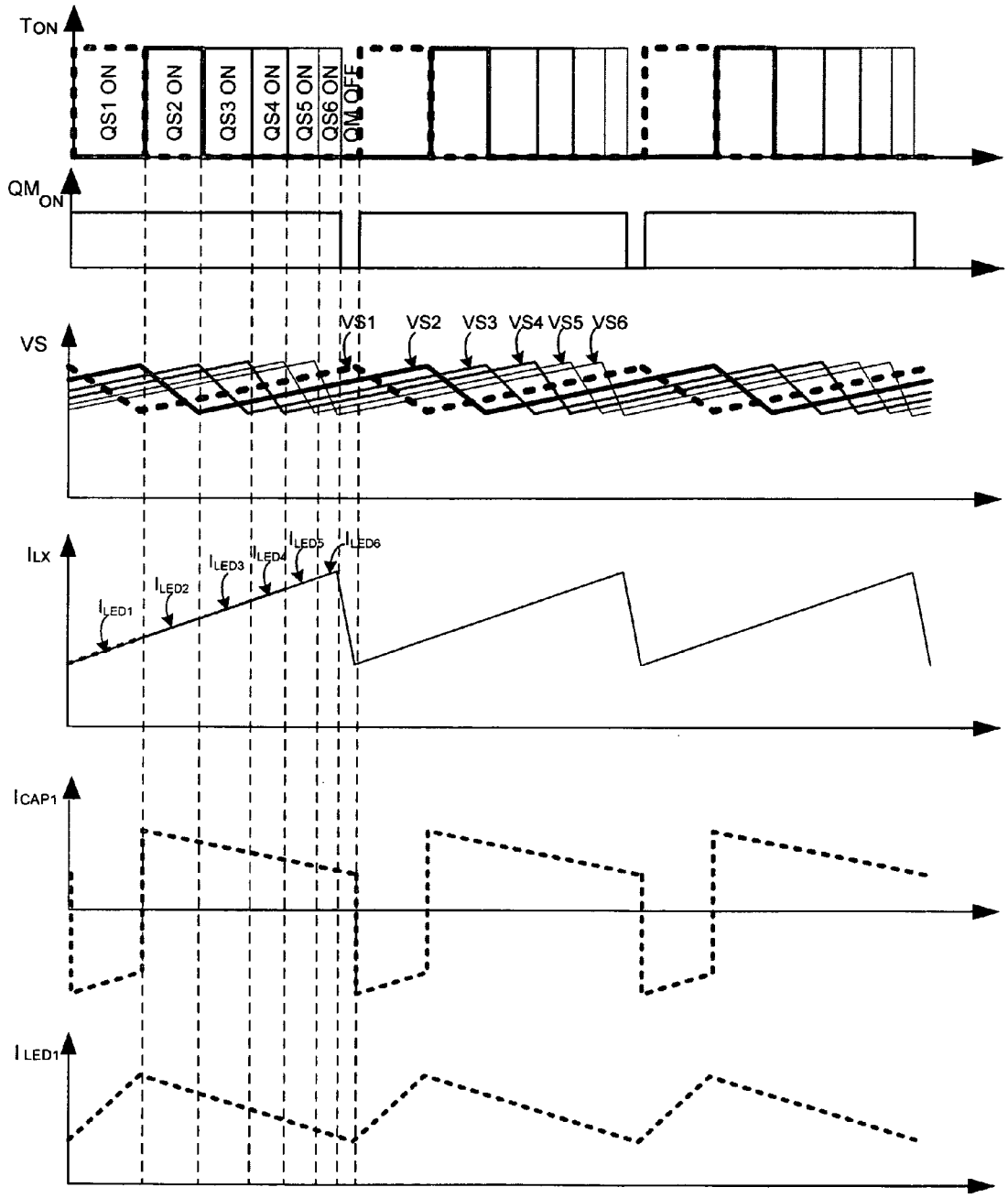
FIG. 7 illustrates waveforms of different switches as well as corresponding voltage and current waveforms during a PWM switching cycle.

Furthermore, because the on-time TONn for each switch QSn is controlled such that the average current flowing across each LED string is equal to each other, and because the total of TONn on-time is equal to the main on-time, the average current flowing across each LED string is thus equal to the total average current through the inductor during the main on-time divided by six. Equation (2) then becomes:

$$\text{Average}(I_{LED}) = \frac{1}{6} * \text{Average}(I_{LXQM}) \quad (3)$$

Where $I_{LED}$ is the average current for each LED string $I_{LXQM}$ is the average inductor current during the main on-time FIG. 7 illustrates waveforms of different switches as well as corresponding voltage and current waveforms during a PWM switching cycle. In the example of FIG. 7, TON represents the ON and OFF time of each LED switches QSn, $QM_{ON}$ represents the ON and OFF time of the main switch QM, VS represents the voltages at terminals S1-S6, $I_{LX}$ represents the current that flows across the common inductor 53, $I_{CAP1}$ represents the current that flows across the first holding capacitor 61 of the first LED string 41, and $I_{LED1}$ represents the current that flows across the first LED string 41. For illustration purpose, the waveforms with regard to the first LED string 41 are denoted as thick dotted lines in FIG. 7. During a first QS1 on-time, LED string current $I_{LED1}$ flows from VHIGH, through LED string 41, through switch QS1, through inductor 53, and through switch QM to ground (see dotted line 91 in FIG. 5). The LED string current $I_{LED1}$ gradually increases as inductor current $I_{LX}$ gradually charges. The voltage across holding capacitor 61 (VS1) decreases when current flowing out from holding capacitor 61 ($I_{CAP1}$ is negative) as it discharges. During a second QS2 on-time (after switch QS1 is turned off and switch QS2 is turned on), the LED string current $I_{LED1}$ decreases because current flows into its holding capacitor 61 ($I_{CAP1}$ is positive), and the voltage VS1 increases as the capacitor charges. The inductor current $I_{LX}$ continues to increase because switch QS2 is turned on. The waveforms of $I_{LED2}$, VS2, and $I_{CAP2}$ are similar to the waveforms of $I_{LED1}$, VS1, and $I_{CAP1}$, respectively. The inductor current $I_{LX}$ continues to increase through the entire main on-time when QS1, QS2 . . . and QS6 are turned on one by one.

After all the QSn switches are selectively turned on one by one during the main on-time of a PWM switching cycle, all the QSn switches are then turned off together during the main off-time. The main switch QM is also turned off while the discharging switch QD is turned on during the main off-time. Consequently, terminal LIIN is couple to ground through switch QD and the polarity of inductor 53 is reversed. Inductor 53 maintains its current $I_{LX}$ by pulling the current from ground through diode rectifier 52 and then all the way to VHIGH (see a thick dot-dashed line 97 in FIG. 5). Because inductor 53 is now negatively biased, it starts to discharge and its current $I_{LX}$ starts to gradually go down until the next PWM switching cycle starts. As illustrated in FIG. 7, $I_{LX}$ continues to increase through the main on-time and quickly decreases through the main off-time. Moreover, although $I_{LX}$ decreases through the main off-time, it never drops to zero. Thus, inductor 53 operates in a continuous conduction mode. This can be achieved by controlling the duration of the main off-time to be short enough such that $I_{LX}$ never drops to zero.

It can be seen from FIG. 7, that while the inductor current $I_{LX}$ continues to increase during the main on-time for each switch QSn on-time, the amount of on-time for each switch QSn continues to decrease. This is because the total amount of charge over the time for each LED string current is regulated to be the same to ensure the average current is also the same. Thus, when the current increases, the on-time needs to decrease such that the integrated current remains the same for each LED string. In the example of FIG. 7, the QSn switches are turned on in the order of QS1, QS2 . . . QS6. Ideally, the order of turning on the QSn switches does not matter because the average LED string current is regulated to be equal to each other based on the integrated current. However, if the order remains unchanged, then the on-time for QS1 is always the longest ($I_{LED1}$ is the smallest during TON1), and the on-time for QS6 is always the shortest ($I_{LED6}$ is the largest during TON6). It is thus preferred that each LED string operates in exactly the same manner over the time to achieve perfect matching, considering any second-order effect. In one embodiment, shifter 68 generates an alternating order sequence to turn on the QSn switches such that each QSn has on average approximately the same chance to be turned on at a given time.

Figure 8:
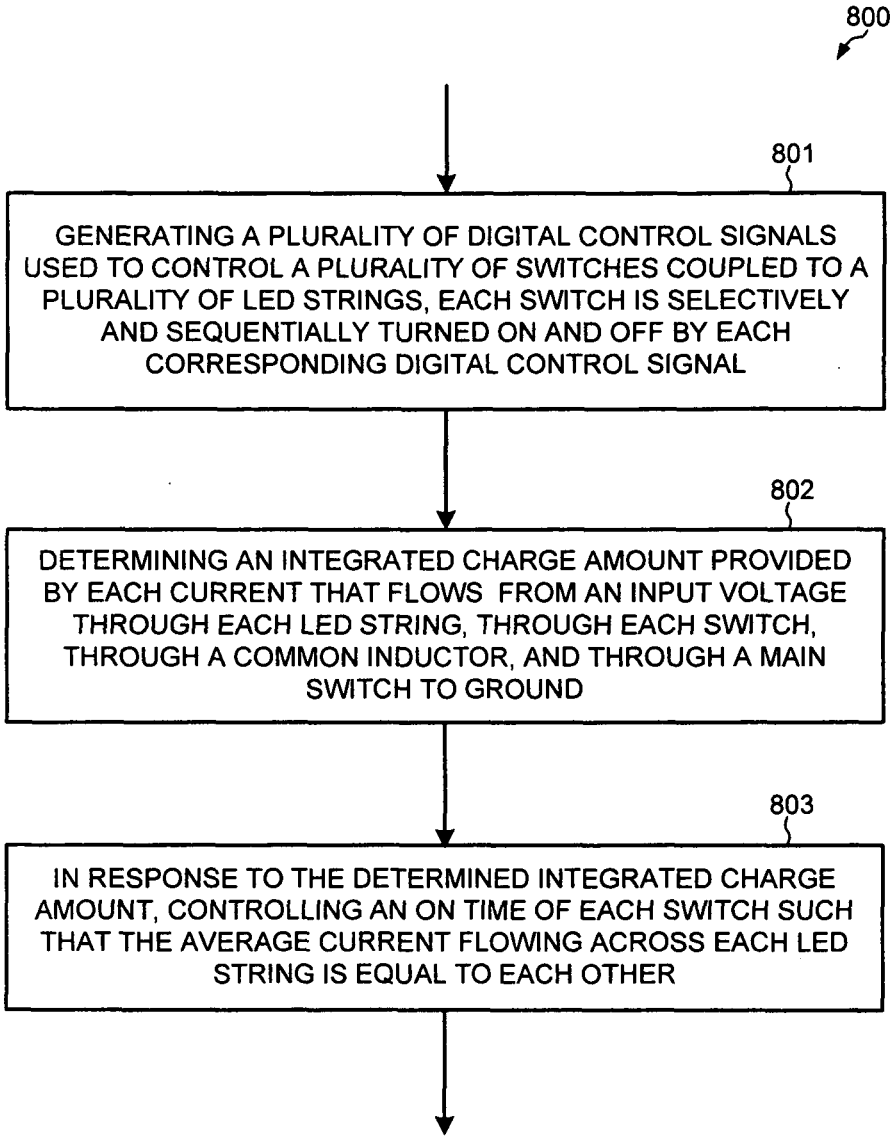
FIG. 8 is a flow chart of a method of driving multiple LED strings using a single inductor in accordance with one novel aspect.

FIG. 8 is a flow chart of a method of driving multiple LED strings using a single inductor in accordance with one novel aspect. A single inductor multiple LED string driver comprises a switch control circuit and a current-sensing control circuit. In step 801, the switch control circuit generates a plurality of digital control signals that are used to control a plurality of switches coupled to a plurality of strings of LEDs. Each switch is selectively turned on and off by each corresponding digital control signal. In step 802, the current-sensing control circuit determines an integrated charge amount provided by each current that flows from an input voltage through each string of LEDs, through each switch, through a common inductor, and through a main switch to ground. In step 803, in response to the determined integrated charge amount, the current-sensing control circuit generates an on-time control signal that controls the on-time of each switch such that the average current flowing across each string of LEDs is equal to each other. In addition, the total current flowing across each LED string is regulated to a predefined value.

Figure 9:
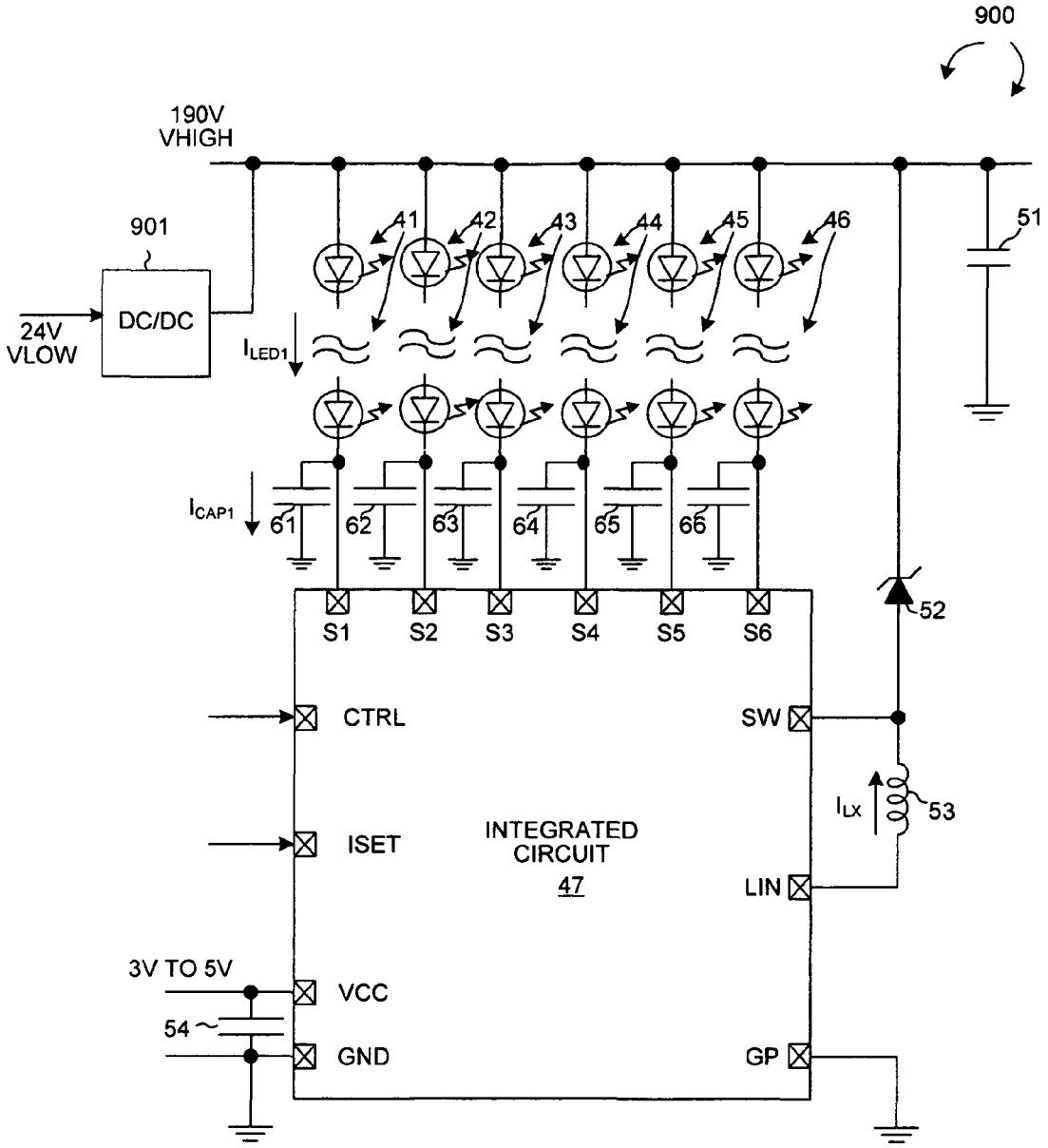
FIG. 9 is a diagram of a second embodiment of a single inductor multiple LED driver in accordance with one novel aspect.

FIG. 9 is a diagram of a second embodiment of a single inductor multiple LED driver 900 in accordance with one novel aspect. Single inductor multiple LED driver 900 is very similar to the single inductor multiple LED driver 40 illustrated in FIG. 4. In the embodiment of FIG. 9, however, the DC voltage VHIGH is provided by a DC-to-DC converter 901. The DC-to-DC converter 901, for example, receives a DC voltage VLOW (e.g., 24V) and outputs DC voltage VHIGH (e.g., 190V) for the multiple LED strings. The use of DC-to-DC converter 901 introduces ~20% undesirable efficiency loss.

Figure 10:
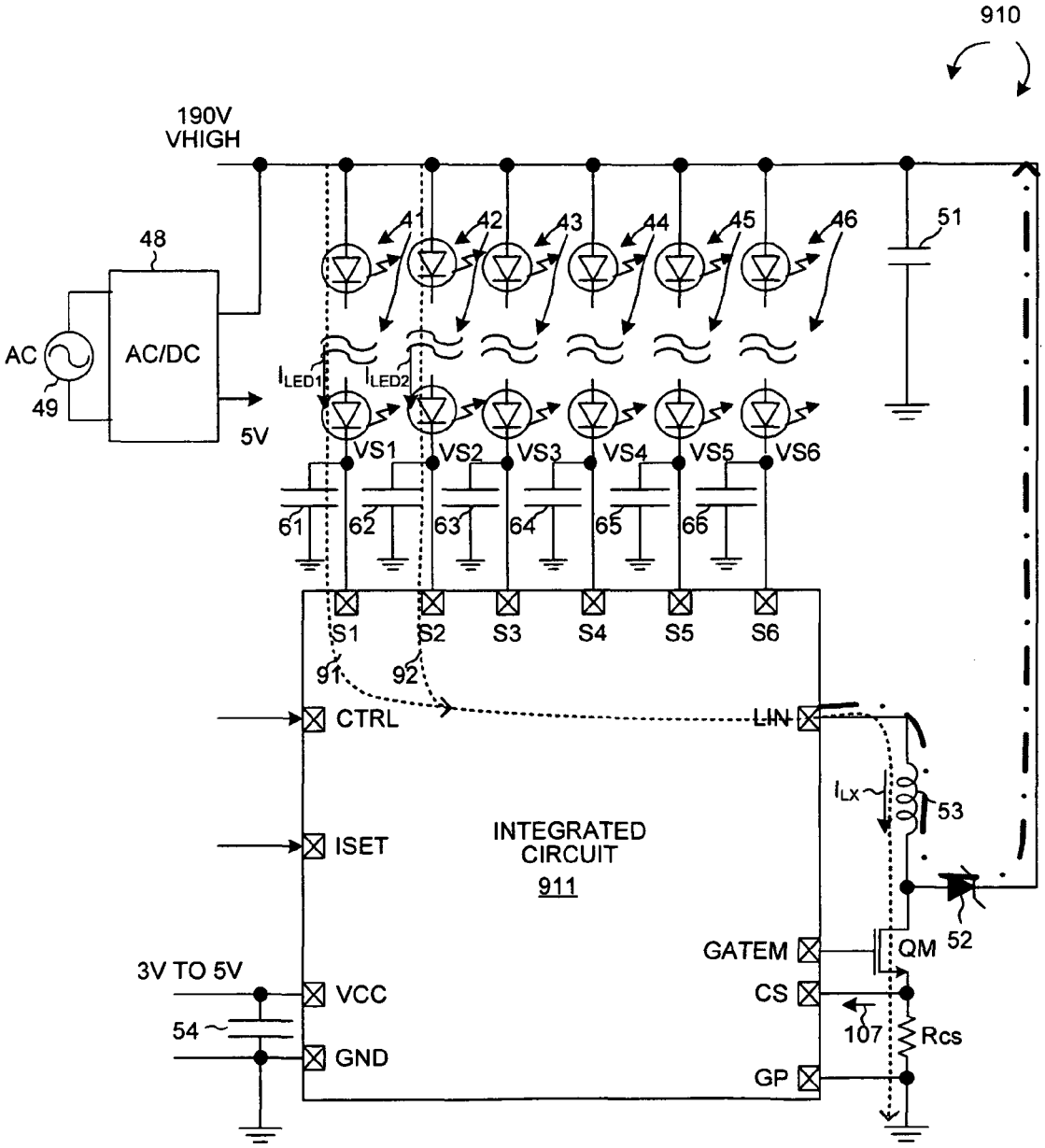
FIG. 10 is a diagram of a third embodiment of a single inductor multiple LED driver in accordance with another novel aspect.

FIG. 10 is a diagram of a third embodiment of a single inductor multiple LED driver 910 in accordance with one novel aspect. Single inductor multiple LED driver 910 is very similar to the single inductor multiple LED driver 40 illustrated in FIG. 4. In the embodiment of FIG. 10, however, common inductor 53 is coupled to a main switch QM that is external to an integrated circuit 911. In addition, the main switch QM is coupled to a current-sensing resistor Rcs that is also external to the integrated circuit 911. Thus, when main switch QM is turned on, the inductor current $I_{LX}$ flows through common inductor 53, through main switch QM, and through resistor Rcs to ground. Integrated circuit 911 controls main switch QM via terminal GATEM and receives a current-sensing signal 107 via terminal CS.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. An integrated circuit comprising:

a current-sensing control circuit that senses a plurality of current flows from a plurality of strings of Light Emitting Diodes (LEDs) through a common inductor and thereby generates a current-sensing control signal; and a switch control circuit that receives the current-sensing control signal and in response outputs a plurality of switch control signals, wherein each switch control signal is used to control one of a plurality of switches coupled to a corresponding one of the plurality of strings of LEDs, and wherein each switch control signal alternatively controls an on time of each switch such that an average current flowing across each string of LEDs is equal to a target current value.

2. The integrated circuit of claim 1, wherein the integrated circuit comprises the plurality of switches.

3. The integrated circuit of claim 1, wherein the switch control circuit also generates a main control signal that controls a main switch coupled to the common inductor.

4. The integrated circuit of claim 1, wherein there are N strings of LEDs, N is an integer greater than one, and wherein the average current flowing across each string of LEDs is equal to an average current flowing across the common inductor divided by N.

5. An integrated circuit comprising:

a current-sensing control circuit that senses a plurality of current flows from a plurality of strings of Light Emitting Diodes (LEDs) through a common inductor and thereby generates a current-sensing control signal; and a switch control circuit that receives the current-sensing control signal and in response outputs a plurality of switch control signals, wherein each switch control signal is used to control one of a plurality of switches coupled to a corresponding one of the plurality of strings of LEDs, wherein each switch control signal alternatively controls an on time of each switch such that an average current flowing across each string of LEDs is equal to a target current value, and wherein the current-sensing control circuit comprises a capacitor that is used to determine an amount of an integrated charge provided by each current flowing across each string of LEDs.

6. The integrated circuit of claim 5, wherein the switch control circuit also generates a main control signal that controls a main switch coupled to the common inductor, wherein the switch control circuit comprises a Pulse-Width Modulation (PWM) controller, wherein during an on time of the main control signal, the main switch and one of the plurality of the switches are turned on, and wherein during an off time of the main control signal, the main switch is turned off.

7. The integrated circuit of claim 6, wherein an inductor current increases when the main switch is on, wherein the inductor current decreases when the main switch is off, and wherein the inductor operates in continuous conduction mode.

8. The integrated circuit of claim 6, wherein the PWM controller comprises a shifter that selectively turns on each of the plurality of switches during the on time of the main control signal.

9. The integrated circuit of claim 8, wherein a sequence of turning on each switch changes over time such that each switch has on average approximately the same chance to be turned on at a given time.

10. A system, comprising:

a plurality of strings of Light Emitting Diodes (LEDs) coupled to an input voltage;

a common inductor;

a plurality of switches coupled to the plurality of strings of LEDs;

a main switch coupled to the common inductor, wherein a plurality of currents flows from the input voltage to the plurality of strings of LEDs and to the plurality of switches, and wherein each of the currents then flows through the common inductor, and then through the main switch to ground; and a control circuit that alternatively controls each of the plurality of switches such that an average current flowing across each string of LEDs is equal to a target current value.

11. The system of claim 10, wherein each string of LEDs has a first end and a second end, wherein the first end is directly coupled to the input voltage, and wherein the second end is coupled to a corresponding switch.

12. The system of claim 11, wherein the second end of each string of the LEDs is also coupled to a holding capacitor.

13. The system of claim 10, wherein the control circuit is part of an integrated circuit comprising a Pulse-Width Modulation (PWM) controller, wherein during an on time of a PWM signal, the main switch and one of the plurality of the switches are turned on, and wherein during an off time of the PWM signal, the main switch is turned off.

14. The system of claim 13, wherein an inductor current increases when the main switch is on, wherein the inductor current decreases when the main switch is off, and wherein the inductor operates in continuous conduction mode.

15. The system of claim 10, wherein there are N strings of LEDs, N is an integer greater than one, and wherein the average current flowing across each string of LEDs is equal to an average current flowing across the common inductor divided by N.

16. The system of claim 10, wherein the control circuit comprises a capacitor that is used to determine an amount of an integrated charge provided by each of the current flows across each string of LEDs.

17. The system of claim 10, further comprising:

an Alternating Current to Direct Current (AC-to-DC) converter, wherein the AC-to-DC converter generates the input voltage, wherein the input voltage is an unregulated DC voltage, and wherein the unregulated DC voltage is used to drive the plurality of strings of LEDs.

18. The system of claim 17, wherein the unregulated DC voltage is between one-hundred volts and two-hundred volts.

19. The system of claim 17, wherein the unregulated DC voltage is used to drive the plurality of strings of LEDs without using any DC-to-DC boost converter.

20. A system, comprising:

a plurality of strings of Light Emitting Diodes (LEDs) coupled to an input voltage;

a common inductor;

a plurality of switches coupled to the plurality of strings of LEDs;

a main switch coupled to the common inductor, wherein a plurality of currents flows from the input voltage to the plurality of strings of LEDs and to the plurality of switches, and wherein each of the currents then flows through the common inductor, and then through the main switch to ground; and a control circuit that alternatively controls each of the plurality of switches such that an average current flowing across each string of LEDs is equal to a target current value, wherein the control circuit is part of an integrated circuit comprising a Pulse-Width Modulation (PWM) controller, wherein during an on time of a PWM signal, the main switch and one of the plurality of the switches are turned on, wherein during an off time of the PWM signal, the main switch is turned off, and wherein the PWM controller comprises a shifter that selectively turns on each of the plurality of switches during the on time of the PWM signal.

21. The system of claim 20, wherein the sequence of turning on each switch changes over time such that each switch has on average approximately the same chance to be turned on at a given time.

22. A method, comprising:

(a) generating a plurality of digital control signals that are used to control a plurality of switches coupled to a plurality of strings of Light Emitting Diodes (LEDs), wherein each switch is selectively turned on and off by each corresponding digital control signal;

(b) determining an integrated charge amount provided by each current that flows from an input voltage through each string of LEDs, through each switch, through a common inductor, and through a main switch to ground; and (c) in response to the determined integrated charge amount, controlling an on time of each switch such that an average current flowing across each string of LEDs is equal to each other.

23. The method of claim 22, wherein each string of LEDs has a first end and a second end, wherein the first end is directly coupled to the input voltage, and wherein the second end is coupled to a corresponding switch.

24. The method of claim 22, wherein the second end of each string of the LEDs is also coupled to a holding capacitor.

25. The method of claim 22, wherein the plurality of control signals is generated by a PWM controller, wherein during an on time of a PWM signal, the main switch and one of the plurality of the switches are turned on, and wherein during an off time of the PWM signal, the main switch is turned off.

26. The method of claim 22, wherein there are N strings of LEDs, N is an integer greater than one, and wherein the average current flowing across each string of LEDs is equal to the average current flowing across the common inductor divided by N.

27. The method of claim 22, wherein the determining in (b) involves the use of a capacitor.

* * * * *